United States Patent [19]

McDaniel et al.

[11] 4,277,188

[45] Jul. 7, 1981

[54] DIRECT KEYBOARD CONTROLLED RACK SHIFT DEVICE FOR A SINGLE ELEMENT TYPEWRITER

[75] Inventors: Robert F. McDaniel, Paris, Ky.; Mike Prewarski, El Paso, Tex.; Leonard D. Ramey, Versailles, Ky.

[73] Assignee: International Business Machines Corporation, Armonk, N.Y.

[21] Appl. No.: 54,760

[22] Filed: Jul. 5, 1979

[51] Int. Cl.[3] ..... B41J 25/24

[52] U.S. Cl. ..... 400/257; 400/161.4

[58] Field of Search ..... 400/161.2, 161.3, 161.4, 400/257

[56] References Cited

U.S. PATENT DOCUMENTS

| | | | |
|---|---|---|---|
| 3,885,662 | 5/1975 | Schaefer | 400/161.4 X |
| 3,892,304 | 7/1975 | Shakib | 400/161.4 X |
| 3,948,381 | 4/1976 | McDaniel et al. | 400/161.4 X |
| 3,981,386 | 9/1976 | Abell et al. | 400/161.4 X |
| 3,983,984 | 10/1976 | de Kler | 400/161.4 |

OTHER PUBLICATIONS

IBM Technical Disclosure Bulletin, "Nonhoming Translating Rack Shift Mechanism", Henderson et al., vol. 18, No. 11, Apr. 1976, pp. 3748-3749.

IBM Technical Disclosure Bulletin, "88-Character Case Shift Mechanism", Abell, vol. 18, No. 11, Apr. 1976, pp. 3751-3752.

IBM Technical Disclosure Bulletin, "Independently Adjustable Rack Toggle Mechanism", Henderson et al., vol. 20, No. 2, Jul. 1977, p. 656.

*Primary Examiner*—Ernest T. Wright, Jr.

*Attorney, Agent, or Firm*—Laurence R. Letson

[57] ABSTRACT

A device is disclosed for shifting a bifurcated rack from one position to a second position, thereby engaging alternate sides of a bifurcated rack member with a pinion in a spacially fixed position. The rack shift mechanism is controlled by a direct link to the keyboard of the typewriter which responds to movement of a shift key lever. The mechanism performs a force multiplication and, at the same time, a displacement division function to reduce a relatively large key lever and link displacement to a relatively small rack displacement with a correspondingly higher force factor. The force multiplication linkage translates the rack of the rack/pinion pair to engage the alternate portion of the rack, thereby reversing the rotation of the pinion and allowing the selection from the opposite hemisphere of the type element in response to a selection output.

4 Claims, 3 Drawing Figures

DIRECT KEYBOARD CONTROLLED RACK SHIFT DEVICE FOR A SINGLE ELEMENT TYPEWRITER

BACKGROUND OF THE INVENTION

The invention relates to the field of character selection and control mechanisms for a single element typewriter.

Dual rack and single pinion selection trains are known in single element typewriters as is exemplified by U.S. Pat. No. 3,892,304 to Shakib, and commonly assigned with this application. The shifting of that rack is controlled by a mechanical drive, inasmuch as due to the moving print carrier, it is not feasible to construct a direct link from the keyboard.

With the fixing of the type element in a spacially fixed position with respect to the typewriter frame, and the translation of the platen past the print element to create a writing line, the opportunity to simplify the rack shifting and thus selection of the opposite hemisphere of the print element, is presented. Previously, the linkages to the keyboard were in the form of electrical signals which were controlled as a result of electronic controls which receive signals from the keyboard, process them and send signals to control magnets on the print carrier. This approach of rack shifting control is relatively more expensive and requires considerable testing and checking during assembly. Further extensive design and development work is required to implement the electronic controls contemplated by such a system.

Other techniques of shifting a typehead involve a machine cycle such as that accomplished by the operation of the shift cycle of the IBM SELECTRIC typewriter. Although this device does not utilize a rack/pinion pair requiring shifting, it is exemplary of powered shifts. The requirement of a machine cycle for shifting the typehead and presenting the opposite hemisphere thereof to the print point breaks the rhythm of typing, together with the requirement of relatively expensive materials and equipment to accomplish the powered shift. It has further been found that for reliable error-free operation, powered shifts require extensive and expensive powered interlocks to prevent breakage of parts in the typewriter and prevent malselection errors. A direct shifting from the keyboard provides the opportunity to eliminate interlocks or, at least, if the interlock is desired, to implement a considerably simpler interlock since no power drives are involved in the shifting of the rack.

OBJECT OF THE INVENTION

It is an object of the invention to shift a bifurcated rack to engage the opposite rack portion thereof with a pinion in a selection train of single element typewriter without a powered machine cycle.

It is a further object of this invention to reverse head rotation by direct keyboard control.

It is an additional object of the invention to eliminate powered interlocks in the typewriter insofar as rack shift and print are involved.

It is still another object of the invention to increase the reliable operation of a rack shifting mechanism to reverse rotation of the head of the printing element.

It is an additional object of the invention to eliminate critical timing of operations in the selection train of a single element typewriter by accomplishing rack shifting without a powered machine cycle.

The aforegoing objects of the invention are accomplished and the shortcomings of the prior art overcome by directly linking the rack shifting function in a single element typewriter involving a bifurcated rack and pinion rotate drive for the typehead, directly to the keyboard of the typewriter. This is accomplished by tying a link from the shift key lever through an appropriate direction changing mechanism to a displacement dividing and force multiplying mechanism which would translate a rack such that a first rack is disengaged from a pinion and a second rack engaged with the same pinion under relatively high loading forces with relatively small displacements as compared to the keyboard key lever travel.

By multiplying the shifting forces, a positive shifting of the rack is accomplished while, at the same time, dividing the displacement to accommodate a relatively large key lever travel. A single vane and dual slot arrangement is provided to prevent the rack from inadvertently disengaging from the pinion regardless of which portion of the rack is directly engaged with the pinion, during a period other than at the home position of the rack and pinion.

DETAILED DESCRIPTION OF THE DRAWING

Figure 1:
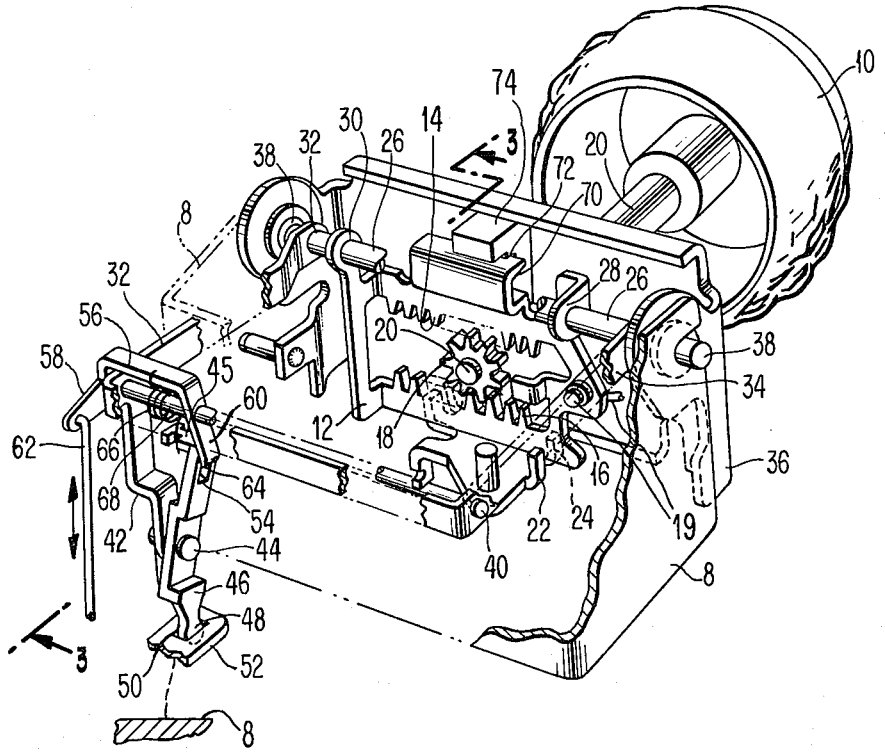
FIG. 1 is a bottom rear prospective of the rocker, typehead and rack and pinion, together with the rack shifting mechanism.

In a single element typewriter, a typehead 10 carries on its periphery in rows and columns the typefont to create the printing. The typehead 10 must, of necessity, be rotated to select the appropriate column and tilted to select the appropriate row of the typehead 10 in order to print the selected character at the print point. The rotation of the typehead 10 may be accomplished by many techniques but a particularly desirable technique has been the use of bifurcated rack 12 having a single rack 14 on one side and a second rack 16 on the opposite side. Racks 14 and 16 are alternately engageable with pinion 18 attached to and rotationally supported by shaft 20. Shaft 20 constitutes a portion of the ball socket of the selection system and is fully akin to shaft 150 in FIG. 9 of the Shakib U.S. Pat. No. 3,892,304, referred to above, for causing rotation of the typehead 10 and is fully substituteable, together with the other ball socket connections into this environment. Rack member 12 is translatable from right to left in FIG. 1 to effect the rotation of pinion shaft 20. The rotation of shaft 20 in turn rotates typehead 10, thus if rack 14 is engaged with pinion 18, the rotation of the typehead 10 is in a counterclockwise direction during the selection movement and clockwise direction during the restore movement of rack 12, while the opposite directions apply upon the engagement of rack 16 with pinion 18. As can be seen, if rack 14 or 16 provides a 180° maximum rotation of pinion 18 when engaged therewith, by the use of the two racks 14,16 complete accessibility to all columns of characters on typehead 10 is accomplished. A convenient arrangement of characters on typehead 10 dictates that one hemisphere of the typehead can be composed of lower case characters and symbols while the opposite hemisphere can be composed of upper case characters and symbols. Effectively, the shifting of the rack 12 then becomes a case shift operation.

The rack 12 is supported for sliding movement by support tabs 22 and 24 which form a slot there between. Rack 12 may not only slide right to left and left to right in the slot between tabs 22 and 24 under the influence of link 19 but may also be moved in a direction corresponding to up and down in FIG. 1. Rack 12 is further supported on a shaft 26 at pivots 28 and 30. Shaft 26 extends through pivots 28 and 30 and allows the rack 12 to shift laterally along the axis of shaft 26. Shaft 26 is further supported in rack shift arms 32 and 34. The typehead 10 is rotated by shaft 20 extending through and rotateably fixed in rocker 36.

Rocker 36 may be pivoted about its pivot pins 38 to cause the typehead 10 to impact onto platen 39 to effect printing. Pivot pins 38 do not extend all the way across the rocker 36 and are not joined to shaft 26. Rack shift arms 32 and 34 are pivotally mounted upon pivot shaft 40. Pivot shaft 40 extends between arm 32 and arm 34.

The two arms 32 and 34 are formed from a single piece of material bent into a generally U-shaped form. Extending from arm 32 is a second arm 42 which forms a bellcrank. The outermost end of arm 42 is connected by means of a pivot pin 44 to a lever 46. Lever 46 is formed with one end in a ball or bulbous form 48 for insertion into a retaining apperture 50 formed in a grounded restraint member 52 attached to the frame 8. This effectively provides a fulcrum or pivot point in both directions on the faces of apperture 50. The opposite end of lever 46 is provided with an apperture 54. Likewise pivoted on shaft 40 is a bellcrank 56 having arms 58 and 60. Arm 58 is connected to a link 62 extending toward the keyboard and actuateable by movement of a shift key lever 80. The bellcrank arm 60 is provided with an engaging finger or tab 64 which further engages apperture 54 of lever 46. The bellcrank 56 further provides a force point for over center spring 66. The opposite end 68 of the over center spring 66 engages a tab formed into the end 45 of lever 46.

Referring again to FIG. 1, rack 12 is prevented from inadvertently shifting or disengaging one of its racks 14 or 16 from pinion 18 by the engagement of vane 70 with one of two grooves or slots 72 formed into a guide block 74.

The vane 70, as illustrated in FIG. 1, is fully engaged with one of the grooves 72. This will prevent the rack 12 from inadvertent or improper movement with respect to the pinion 18. The vane 70 and its relative positioning with respect to the racks 14 and 16 is such that the vane 70 is not engaged with either of the grooves or slots 72 when the rack 12 is in its home or nonoperative position. Thus, when the shifting mechanism is actuated by movement of shift link 62, the rack 12 may translate laterally in response to the shift link input and then enter the appropriate groove 72. Vane 70, in conjunction with one of the grooves 72, acts as an interlock during the selection portion of the machine cycle, thereby insuring continuous engagement of the appropriate rack 14,16 with pinion 18.

Figure 2:
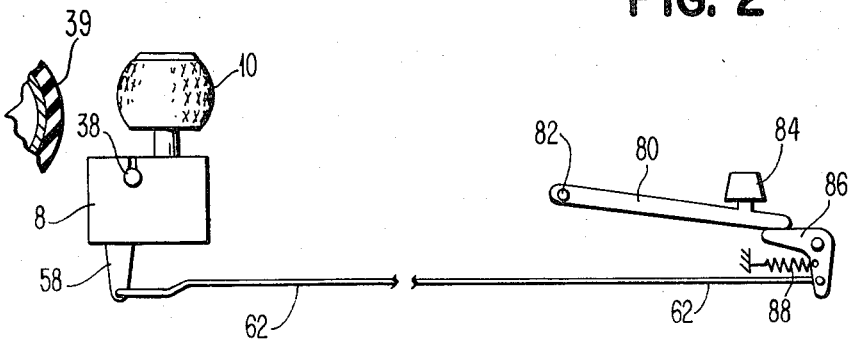
FIG. 2 is a left elevation of the rack shifting mechanism.
Figure 3:
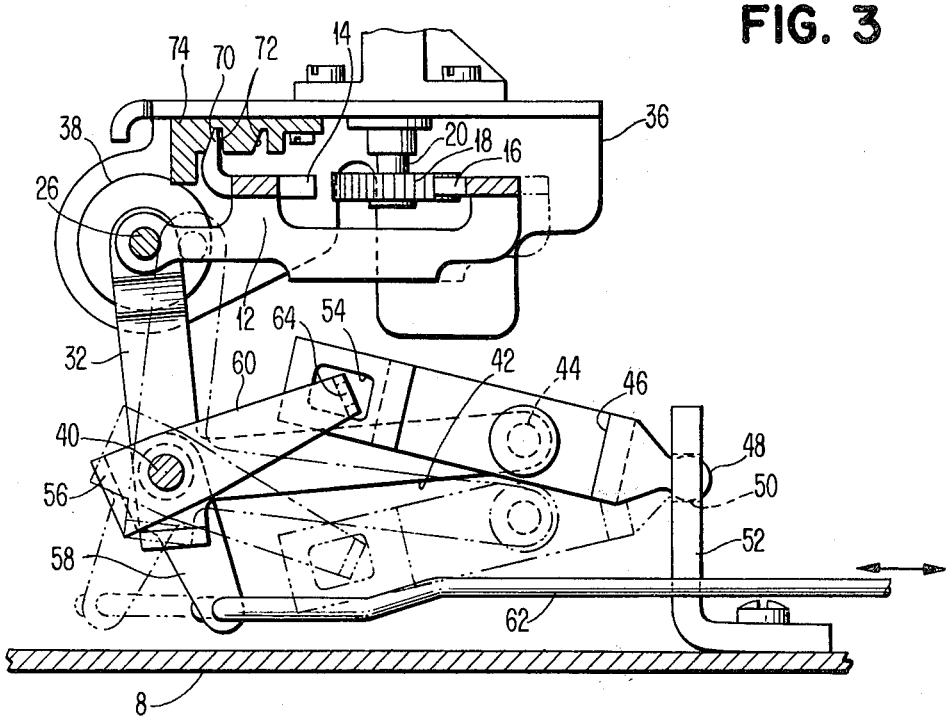
FIG. 3 is a left sectional view along line 3—3 in FIG. 1 of the arrangement of the rocker and rack shifting mechanism as it relates to the link and key lever control at the keyboard.

FIG. 2 illustrates the keyboard arrangement wherein shift key lever 80 is pivoted at a pivot point 82 for movement under the influence of a force exerted on the key button 84. As key button 84 moves downward oscillating key lever 80, the end thereof engages bellcrank 86. Bellcrank 86 acts against restore spring 88 and translates link 62 rightward effecting the shift of the rack shifting mechanism to its second operative position and, in so doing, the bellcrank arm 58 moves to raise arm 42 moving the pivot pin 44 of lever 46 upward. With the upward movement of pivot pin 44, arm 60 of bellcrank 56 is raised, thereby moving rack shift arms 32, 34 to a position illustrated in FIG. 1 and FIG. 3 with the solid lines. The opposite action is accomplished when the key lever 80 is released causing the restore spring 88 to act on bellcrank 86, thereby pushing the link 62 in the opposite direction causing the bellcrank 56 and rack shift arms 32, 34 to assume the position indicated in FIG. 3 by the phantom lines. In so doing, the rack 12 is restored to its lower case position with rack 14 in engagement with pinion 18.

The shifting of the rack 12 can only be accomplished at the home or rest position when vane 70 is not engaged and confined to lateral movement by either of the interlock slots 72.

While the invention has been particularly shown and described with reference to (a) preferred embodiment(s) thereof, it will be understood by those skilled in the art that the foregoing and other changes in form and details may be made therein without departing from the spirit and scope of the invention.

We claim:

1. A typewriter comprising a platen, a selectable print element, means for rotating said selectable print element, means for controlling the direction of rotation of said print element, a keyboard comprising operator controlled means connected to said means for controlling the direction of rotation, said connection between said operator controlled means and said means for controlling the direction of rotation further comprising a force multiplying, displacement dividing means for converting an output of said operator control means into a mechanical displacement for operating said means for controlling the direction of rotation.

2. A typewriter typehead rotation apparatus comprising: a typehead, a means for supporting said typehead and transmitting rotational motion to said typehead; a pinion attached to said means for supporting and transmitting rotational motion; a bifurcated rack member having two racks selectively engageable to engage one of said racks with said pinion for determining the direction of rotation; means for moving said rack member linearly with respect to said pinion; a displacement dividing, force multiplying linkage having two stable positions and connected to the said rack member for effecting movement of said rack member from engagement with said pinion of said one of said racks to the other of said racks, control means operable by an operator, for effecting transition of said displacement dividing, force multiplying linkage from one of said two stable positions to the other of said two stable positions, for translating said rack member from engagement of said one rack to the engagement of said other rack with said pinion.

3. The apparatus of claim 2 wherein said control means is the sole power for effecting translation from said one of said two stable positions to said other of said two stable positions.

4. The apparatus of claim 3 wherein said displacement dividing, force multiplying linkage comprises a first bellcrank having an output arm and being operator moveable, a second bellcrank having an input arm, said second bellcrank connected to move said bifurcated rack member;

a lever, said lever having a spatially fixed end and a moveable end;

said bellcranks pivotally mounted on a common axis;

said first bellcrank's output arm engaged with said lever's moveable end;

said second bellcrank's input arm connected at a pivotal connection to said lever, intermediate said ends of said lever, forming two lever arms, whereby any force exerted by said first bellcrank is multiplied and any displacement caused by said first bellcrank is divided according to the respective ratios of said lever arms of said lever and length of said arms of said bellcranks.

* * * * *